US011707933B2

(12) United States Patent
Miyase et al.

(10) Patent No.: US 11,707,933 B2
(45) **Date of Patent: *Jul. 25, 2023**

(54) IMAGE RECORDING APPARATUS

(71) Applicant: BROTHER KOGYO KABUSHIKI KAISHA, Nagoya (JP)

(72) Inventors: Satoshi Miyase, Nagoya (JP); Yoshinori Osakabe, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/869,864

(22) Filed: Jul. 21, 2022

(65) Prior Publication Data

US 2022/0355590 A1 Nov. 10, 2022

Related U.S. Application Data

(63) Continuation of application No. 17/179,514, filed on Feb. 19, 2021, now Pat. No. 11,420,443.

(30) Foreign Application Priority Data

Feb. 20, 2020 (JP) ..... 2020-026948

(51) Int. Cl.
*B41J 2/175* (2006.01)
*B41J 29/02* (2006.01)
*B41J 29/13* (2006.01)

(52) U.S. Cl.
CPC ..... *B41J 2/1752* (2013.01); *B41J 29/02* (2013.01); *B41J 29/13* (2013.01)

(58) Field of Classification Search
CPC ..... B41J 2/175; B41J 2/17509; B41J 2/1752; B41J 29/02; B41J 29/13
See application file for complete search history.

(56) References Cited

U.S. PATENT DOCUMENTS

| | | | | |
|---|---|---|---|---|
| 6,361,138 | B1 | 3/2002 | Seino et al. | |
| 6,736,486 | B2 | 5/2004 | Nakamura et al. | |
| 7,452,066 | B2 | 11/2008 | Tsuji | |
| 8,678,574 | B2 * | 3/2014 | Adachi | B41J 2/17509 347/86 |
| 9,902,160 | B2 | 2/2018 | Sugiyama et al. | |
| 11,420,443 | B2 * | 8/2022 | Miyase | B41J 2/1752 |

FOREIGN PATENT DOCUMENTS

JP 3081030 U 10/2001

* cited by examiner

*Primary Examiner* — Anh T Vo
(74) *Attorney, Agent, or Firm* — Merchant & Gould P.C.

(57) ABSTRACT

An image recording apparatus includes a cartridge installing unit for detachably installing a plurality of ink cartridges. The cartridge installing unit includes: a base having a placing surface and aligning the plurality of ink cartridges in a first direction on the placing surface; a moving force applying unit moving an ink cartridge of the plurality of ink cartridges from an installation position to a removal position separated from the installation position in a movement direction including a component of the first direction; and a regulating unit regulating the movement of the ink cartridge from the installation position to the removal position. The moving force applying unit moves the ink cartridge from the installation position to the removal position in a case that the ink cartridge is released from the regulation by the regulating unit.

19 Claims, 6 Drawing Sheets

IMAGE RECORDING APPARATUS

CROSS REFERENCE TO RELATED APPLICATION

The present application is a continuation of U.S. patent application Ser. No. 17/179,514, filed Feb. 19, 2021, now U.S. Pat. No. 11,420,443, which claims priority from Japanese Patent Application No. 2020-026948 filed on Feb. 20, 2020, the disclosure of which are incorporated herein by reference in their entirety.

BACKGROUND OF THE INVENTION

Field of the Invention

The present invention relates to an image recording apparatus such as an ink-jet printer or the like.

Description of the Related Art

Conventionally, an on-carriage type image recording apparatus is known, in which a plurality of ink cartridges are carried on a carriage (see, for example, Japanese Utility Model Registration No. 3081030). The carriage has a cartridge installing unit. The plurality of ink cartridges are installed to the cartridge installing unit while being aligned in the lateral direction.

In the case of the image recording apparatus of Japanese Utility Model Registration No. 3081030, the ink cartridge is lifted upwardly by a lifting member at a point in time at which a cover is rotated to arrive at an open position. The ink cartridge, which is lifted upwardly, protrudes upwardly as compared with another ink cartridge which is disposed adjacently to one another. A user easily grasps a protruding portion of the ink cartridge. The exchange operation performance is improved for the ink cartridge.

In recent years, the miniaturization of the image recording apparatus is advanced. It is demanded to realize the miniaturization of the carriage as well. However, the dimension in the upward-downward direction of the apparatus is restricted on account of the miniaturization of the apparatus. As a result, in the case of the image recording apparatus having the conventional structure as described above, it is impossible for the ink cartridge to secure a large dimension in order to protrude upwardly with respect to another ink cartridge which is disposed adjacently. On this account, in the case of the image recording apparatus having the conventional structure, it is difficult to make the miniaturization of the image recording apparatus compatible with the easiness to take out or remove the ink cartridge.

In view of the above, an object of the present invention is to provide an image recording apparatus which has high (satisfactory) exchange operation performance to exchange an ink cartridge.

SUMMARY OF THE INVENTION

According to the present invention, there is provided an image recording apparatus including a cartridge installing unit for detachably installing a plurality of ink cartridges, the cartridge installing unit including:

a base having a placing surface and configured to align the plurality of ink cartridges in a first direction on the placing surface;

at least one moving force applying unit configured to move at least one ink cartridge of the plurality of ink cartridges from an installation position to a removal position separated from the installation position in a movement direction including a component of the first direction; and a regulating unit configured to regulate the movement of the at least one ink cartridge from the installation position to the removal position, wherein the at least one moving force applying unit moves the at least one ink cartridge from the installation position to the removal position in a case that the at least one ink cartridge is released from the regulation by the regulating unit.

DESCRIPTION OF THE PREFERRED EMBODIMENTS

An explanation will be made below with reference to the drawings about an image recording apparatus according to an embodiment of the present invention. The image recording apparatus explained below is merely an embodiment of the present invention. Therefore, the present invention is not limited to the following embodiment. It is possible to make addition, deletion, and change within a range without deviating from the gist or essential characteristics of the present invention.

First Embodiment

Figure 1:
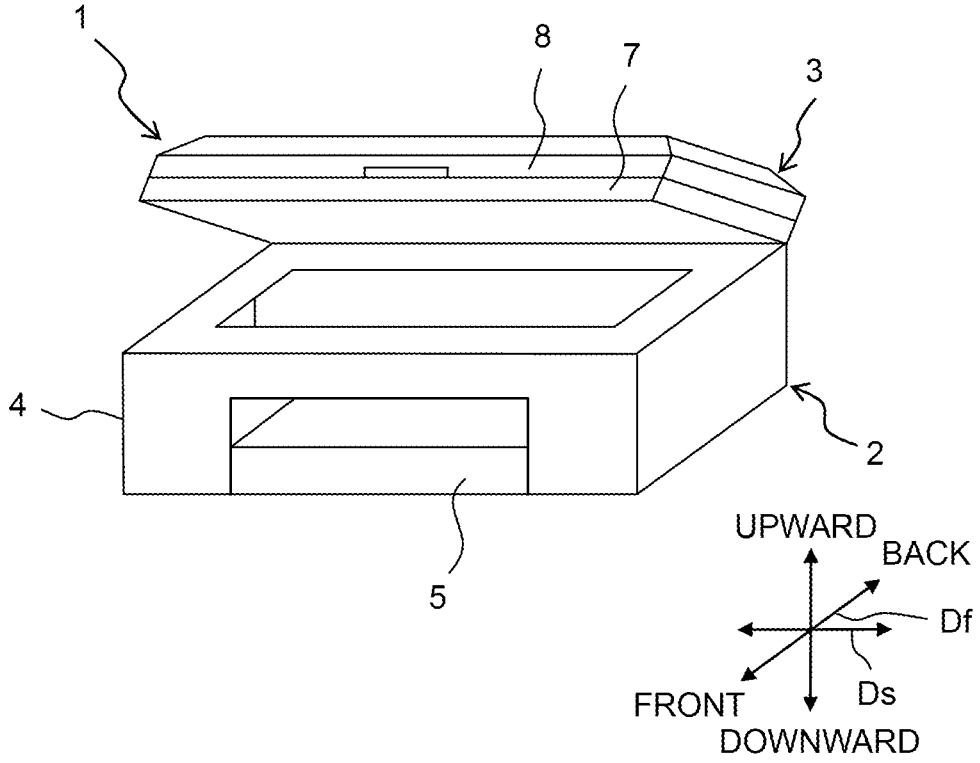
FIG. 1 shows a perspective view illustrating an appearance of an image recording apparatus according to a first embodiment.

At first, an explanation will be made about an example of the image recording apparatus according to this embodiment. As shown in FIG. 1, the image recording apparatus 1 is, for example, an ink-jet printer for recording an image on the recording paper as a recording medium, and the image recording apparatus 1 has a rectangular parallelepiped-shaped appearance. The image recording apparatus 1 is provided with a printer unit 2 and a scanner unit 3. Note that in the following explanation, the upward-downward direction and the front-back direction orthogonal to the upward-downward direction are defined as shown in FIG. 1 on the basis of a state (state shown in FIG. 1) in which the image recording apparatus 1 is installed usably.

The scanner unit 3 reads the image by means of an image pickup element to generate image data. The generated image data is printed in the printer unit 2 on the recording paper which is accommodated in the image recording apparatus 1 or which is supplied from the outside of the image recording apparatus 1. The scanner unit 3 as described above is arranged while being stacked on the printer unit 2. The scanner unit 3 is connected to the printer unit 2 by means of an unillustrated hinge which is provided at a back portion of the printer unit 2. Therefore, when a front portion of the scanner unit 3 is lifted, then the scanner unit 3 is rotated upwardly with respect to the printer unit 2 about the supporting point of the hinge, and the interior of the printer unit 2 is exposed thereby.

The scanner unit 3 has a manuscript stand 7 and a cover 8. The cover 8 covers an upper portion of the manuscript stand 7. The scanner unit 3 reads the image recorded on the manuscript in a state in which the manuscript is arranged between the manuscript stand 7 and the cover 8.

The printer unit 2 records the image on the recording paper by using inks supplied from ink cartridges 18 as described later on (see FIG. 2). The printer unit 2 is provided with a case 4 which forms a part of a casing of the image recording apparatus 1. A tray 5 for accommodating the recording paper is arranged at the inside of the case 4. The tray 5 can be supplemented with the recording paper by drawing the tray 5 frontwardly with respect to the case 4.

Subsequently, a liquid discharge apparatus 10 will be explained. As shown in FIG. 2, the liquid discharge apparatus 10 is provided with a carriage 16, a guide rail 17 which movably supports the carriage 16, an unillustrated conveying roller and an unillustrated conveying motor which constitute a conveying unit, and the ink cartridges 18 which have discharge heads. Note that the liquid discharge apparatus 10 is provided with an unillustrated platen. The recording paper is arranged on the platen.

Figure 2:
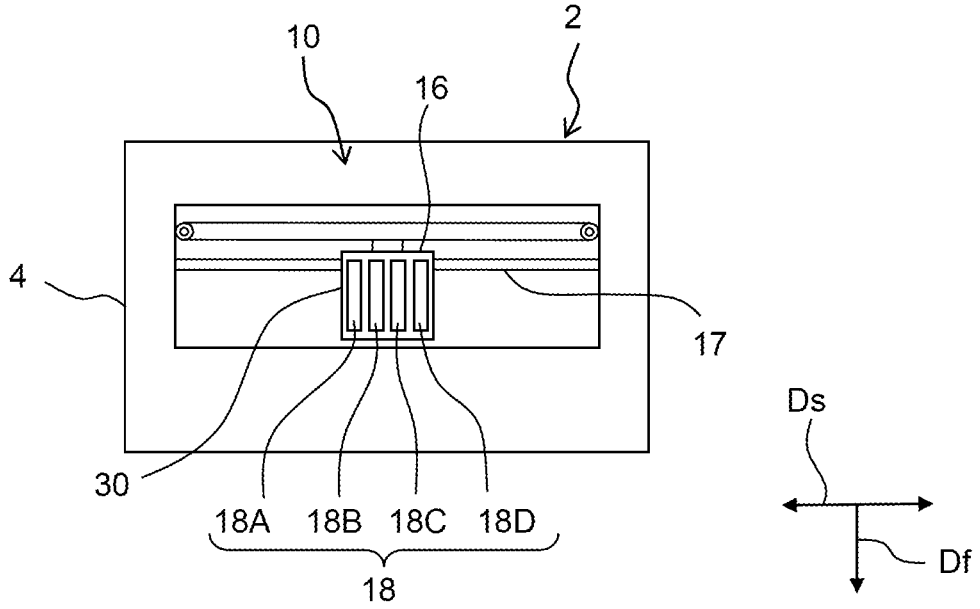
FIG. 2 shows a plan view illustrating a schematic arrangement of a liquid discharge apparatus according to the first embodiment.

As shown in FIG. 2, a cartridge installing unit 30 is provided on the upper surface side of the carriage 16. The four ink cartridges 18A to 18D (hereinafter generally referred to as "ink cartridges 18" in some cases), which accommodate the inks of four colors (black, cyan, magenta, and yellow) respectively, are detachably installed to the cartridge installing unit 30. The discharge head (not shown), which is formed with nozzles for discharging the ink, is attached to the lower surface side of the ink cartridge 18. That is, the ink cartridge 18 is an integrated type cartridge which is integrated with the discharge head. As described above, the image recording apparatus 1 of this embodiment is an on-carriage type image recording apparatus in which the carriage 16 is loaded with the ink cartridges 18.

The carriage 16 is supported by the guide rail 17. The guide rail 17 extends in the main scanning direction Ds (first direction). The main scanning direction (first direction) Ds is orthogonal to the conveying direction of the recording paper, i.e., the subsidiary scanning direction (second direction) Df. The carriage 16 is reciprocatively movable in the main scanning direction Ds along the guide rail 17. Then, the inks are discharged from the nozzles of the discharge heads described above toward the recording paper conveyed in the subsidiary scanning direction Df under or below the carriage 16, and thus the image is formed on the recording paper. Note that in this embodiment, the subsidiary scanning direction (second direction) Df is the front-back direction shown in FIG. 1. Therefore, the main scanning direction (first direction) Ds and the subsidiary scanning direction (second direction) Df are orthogonal to the upward-downward direction (third direction).

The conveying roller described above is connected to the conveying motor described above. When the conveying motor is driven, then the conveying roller is rotated, and the recording paper on the platen is conveyed in the conveying direction.

The discharge head is moved in the main scanning direction Ds in accordance with the movement of the carriage 16, and the discharge head has the plurality of nozzles which discharge the inks with respect to the recording paper. The discharge head has a stack of a flow passage-formed member and a volume changing unit. Liquid flow passages are formed at the inside of the flow passage-formed member. A plurality of nozzle holes are open on a discharge surface as the lower surface of the flow passage-formed member. The ink, which is stored in the corresponding ink cartridge 18, is supplied to the nozzle holes.

Figure 3A:
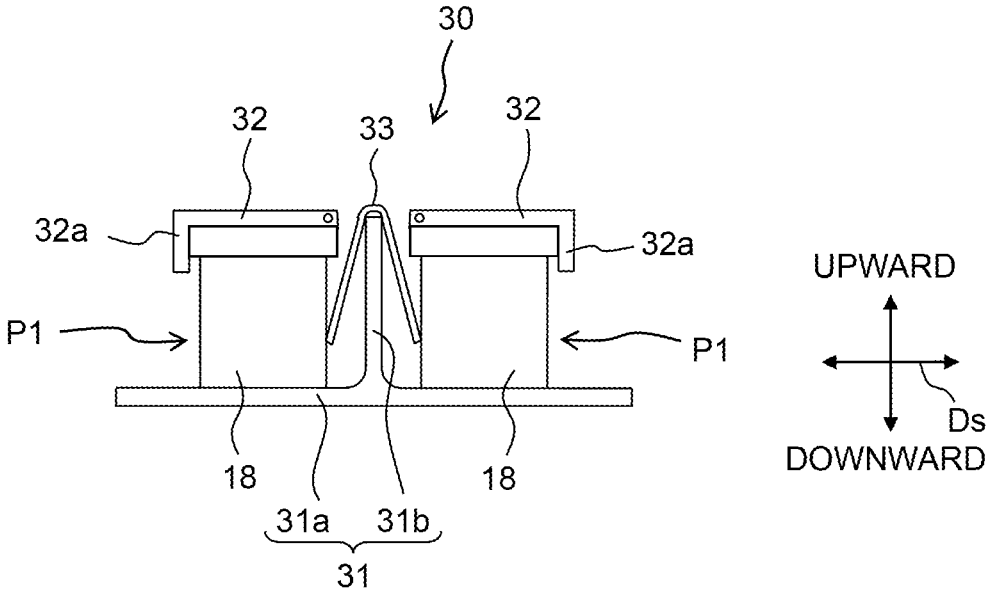
FIG. 3A shows a state provided before removing ink cartridges in the first embodiment.
Figure 3B:
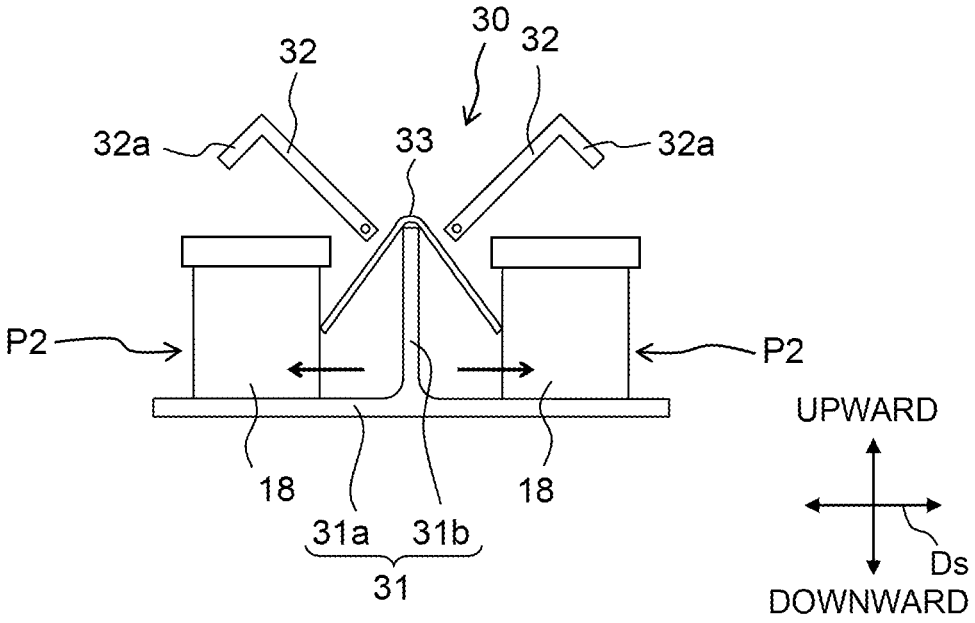
FIG. 3B shows a state provided when the ink cartridges are removed.

Next, an explanation will be made about the configuration and the method for taking out the ink cartridge 18 when the ink cartridge 18 is exchanged in the first embodiment. FIGS. 3A and 3B show a cartridge installing unit 30 as viewed from the front (from the downstream side in the conveying direction, i.e., in the subsidiary scanning direction (second direction) Df).

As shown in FIG. 3A, the respective ink cartridges 18 are provided and aligned in the main scanning direction Ds. The respective ink cartridges 18 are held or retained by the cartridge installing unit 30. The cartridge installing unit 30 is provided with a main installing body unit 31, two regulating units 32, and a moving force applying unit 33. Note that in this embodiment, as described above, for example, the four ink cartridges 18 are provided. That is, two pairs are provided, each of the pairs including the mutually adjacent two ink cartridges 18. The method for taking out the ink cartridges 18 and the configure thereof are the same in relation to the two pairs. Therefore, with reference to FIG. 3 and the drawings described later on, an explanation will be made about one pair of the ink cartridges 18 (mutually adjoining two ink cartridges 18).

With reference to FIG. 3A, the main installing body unit 31 has a base unit (base) 31*a* having a placing surface on which the respective ink cartridges 18 are placed, and a partition wall 31*b* which is provided on the base unit 31*a* and which comparts the mutually adjoining ink cartridges 18. The base unit 31*a* extends in at least the main scanning direction Ds. Further, the partition wall 31*b* extends in the upward direction from the center in the main scanning direction Ds of the base unit 31*a*. The highest portion of the partition wall 31*b* has a height which is slightly higher than a height of the uppermost surface of the ink cartridge 18. The partition wall 31*b* is provided between the two cartridges 18 which are adjacent to one another in the main scanning direction Ds.

The regulating units 32 are provided corresponding to the respective cartridges 18. The regulating unit 32 is formed, for example, to have a L-shaped form. The regulating unit 32 is configured to be rotatable about the center of the proximal end thereof. Further, an engaging portion 32*a*, which is engageable with an upper end portion of the ink cartridge 18, is provided at the forward end (rotation end) of the regulating unit 32. The position, at which the ink cartridge 18 is engaged with the engaging portion 32*a* of the regulating unit 32, is designated as "installation position P1". The ink can be discharged from the ink cartridge 18 to the recording paper at the installation position P1. Installation positions P3, P5, P7 described later on are also designated in the same manner as described above.

The moving force applying unit 33 applies, to the ink cartridges 18, the moving force to move the ink cartridges 18 in the main scanning direction Ds when the ink cartridges 18 disposed at the installation positions P1 described above are released from the regulation having been exerted by the engaging portions 32*a* of the regulating units 32. The moving force applying unit 33 may be an urging member provided for the partition wall 31*b*, which may be, for example, a plate spring. As shown in FIG. 3A, the moving force applying unit 33, which is the plate spring, has the both ends which are folded downwardly in the directions to make separation from each other while allowing the central portion thereof to be supported by the uppermost portion of the partition wall 31*b*. The both ends of the moving force applying unit 33 abut against the side surfaces of the ink cartridges 18. Accordingly, the respective ink cartridges 18, which are disposed at the installation positions P1, are urged in the main scanning direction Ds by the respective ends of the moving force applying unit 33 in a state in which the movement in the main scanning direction Ds is regulated by the regulating units 32.

In the configuration as described above, as shown in FIG. 3B, when the proximal end portions of the respective regulating units 32 are depressed by a user, the respective regulating units 32 are rotated upwardly by using the proximal end portions as the base points. Accordingly, the ink cartridges 18 are released from the regulation having been exerted by the regulating units 32. When the ink cartridges 18 are released from the regulation, the respective ink cartridges 18 are moved (subjected to parallel displacement) to the removal positions P2 in the main scanning direction Ds from the installation positions P1 by the respective ends of the moving force applying unit 33. Accordingly, the respective ink cartridges 18 are moved to the removal positions P2 as the positions at which the respective ink cartridges 18 are separated from each other in the main scanning direction Ds as compared with the situation in which the respective ink cartridges 18 are disposed at the installation positions P1. Note that unlike the installation position P1, the ink cannot be discharged from the ink cartridge 18 positioned at the removal position 18. Installation positions P4, P6, P8 described later on are also dealt with in the same manner as described above.

As described above, according to the image recording apparatus 10 of this embodiment, when the ink cartridge 18 is released from the regulation having been exerted by the regulating unit 32, the ink cartridge 18, which is disposed at the installation position P1, is moved by the moving force applying unit 33 from the installation position P1 to the removal position P2 separated in the main scanning direction Ds from the installation position P1. Accordingly, the ink cartridge 18 is moved in the main scanning direction Ds. On this account, even when the respective ink cartridges 18 are arranged while being aligned in the main scanning direction Ds, the user easily takes out the ink cartridge 18 after the movement. Therefore, the exchange operation performance of the ink cartridge 18 is improved.

Figure 4:
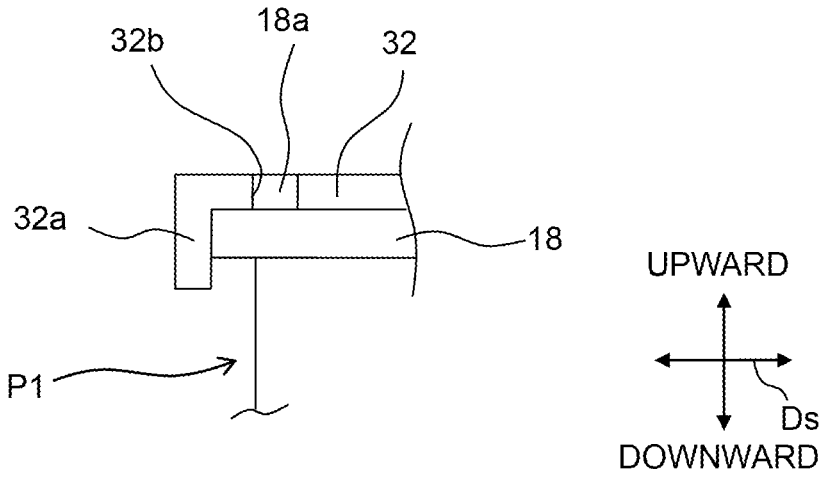
FIG. 4 shows a modified embodiment of the configuration provided to regulate an ink cartridge by a regulating unit.

Note that as shown in FIG. 4, a protrusion 18*a* may be provided at an upper portion of the ink cartridge 18, and a hole (recess) 32*b* to be fitted to the protrusion 18*a* may be provided for the regulating unit 32. The protrusion 18*a* is fitted to the hole 32*b* in a state in which the ink cartridge 18 is engaged with the engaging portion 32*a* of the regulating unit 32. Accordingly, it is possible to strengthen the regulation at the installation position P1 of the ink cartridge 18. Note that on the contrary, a hole (recess) may be provided at an upper portion of the ink cartridge 18, and a protrusion to be fitted to the hole may be provided for the regulating unit 32.

In the first embodiment, the installation position P1 and the removal position P2 are separated from each other in the movement direction including the component of the main scanning direction Ds in the cartridge installing unit 30. In the first embodiment, the movement direction is the main scanning direction Ds. That is, the movement direction includes only the component of the main scanning direction Ds, and the movement direction does not include the component of the subsidiary scanning direction Df and the component of the upward-downward direction. The moving force applying unit 33 allows the ink cartridge 18 to make the parallel displacement in the movement direction (main scanning direction Ds) from the installation position P1 to the removal position P1. The moving force applying unit 33 moves the ink cartridge 18 in the orientation to be separated farther from the partition wall 31*b* in the movement direction. In the main scanning direction Ds, the maximum distance between the partition wall 31*b* and the ink cartridge 18 disposed at the removal position P2 is larger than the maximum distance between the wall portion 41*b*1 of the partition wall 41*b* and the ink cartridge 18 disposed at the installation position P1. Further, the moving force applying unit 33 moves the two ink cartridges 18 (first cartridge and second cartridge) disposed adjacently to one another in the main scanning direction Ds in the orientation to make separation from each other in the main scanning direction Ds.

Second Embodiment

Figure 5A:
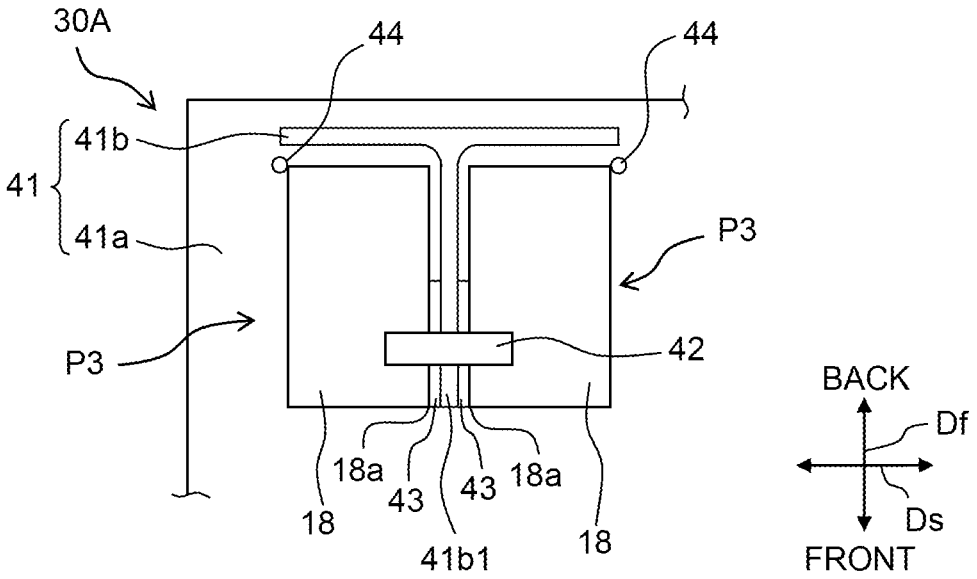
FIG. 5A shows a state provided before removing ink cartridges in a second embodiment.
Figure 5B:
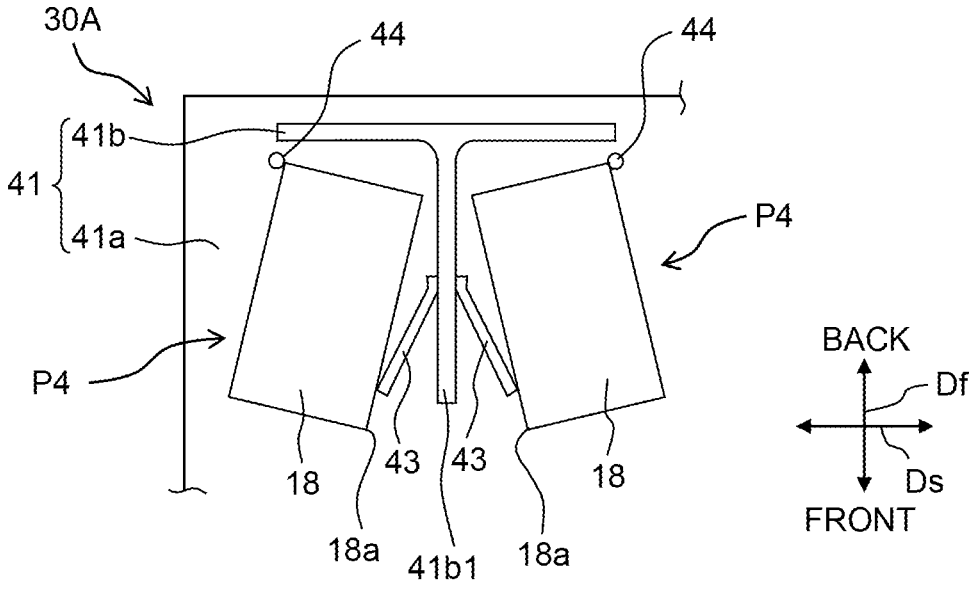
FIG. 5B shows a state provided when the ink cartridges are removed.

Next, an explanation will be made about the configuration and the method for taking out the ink cartridge 18 when the ink cartridge 18 is exchanged in a second embodiment. FIGS. 5A and 5B show situations as viewed from the upward. Note that in the second embodiment, the constitutive elements, which are the same as those of the first embodiment described above, are designated by the same reference numerals, any explanation of which will be omitted. The following respective embodiments will be described in the same manner as described above.

As shown in FIG. 5A, the respective ink cartridges 18 are provided and aligned in the main scanning direction Ds. A cartridge installing unit 30A of this embodiment is provided with a main installing body unit 41, a regulating unit 42, and two moving force applying units 43.

With reference to FIG. 5A, the main installing body unit 41 has a base unit (base) 41*a* having a placing surface on which the respective ink cartridges 18 are placed, and a partition wall 41*b* having, for example, a T-shaped form which is provided on the base unit 41*a* and which comparts the mutually adjoining ink cartridges 18. The base unit 41*a* is formed to have a square shape or a rectangular shape as viewed in a plan view. The partition wall 41*b* extends upwardly from the base unit 41*a*.

The regulating unit 42 has, for example, two engaging protrusions. The respective engaging protrusions are engageable with recesses provided for the respective ink cartridges 18. That is, the regulating unit 42 is configured to be engageable with the two mutually adjacent ink cartridges 18. The position, at which the ink cartridge 18 is engaged with the regulating unit 42, is designated as "installation position P3". Further, the respective ink cartridges 18 are rotatable when the ink cartridges 18 are released from the regulation having been exerted by the regulating unit 42 as described later on. Columnar rotation regulating units (first shafts) 44 are provided at the back of the respective ink cartridges 18. The rotation regulating units 44 extend in the upward-downward direction. The rotation regulating units 44 abut against the surfaces disposed on the side opposite to the surfaces on which the respective ink cartridges 18 make contact with the moving force applying unit 53.

The respective moving force applying units 43 apply the moving force to move the ink cartridges 18 in the directions each including the main scanning direction Ds component and the subsidiary scanning direction Df component with respect to each of the ink cartridges 18 when the ink cartridges 18 are released from the regulation having been exerted by the regulating unit 42 with respect to the ink cartridges 18 disposed at the installation positions P3. The direction (hereinafter referred to as "Ds-Df united direction (combined direction)"), which includes the main scanning direction Ds component and the subsidiary scanning direction Df component, is the direction obtained by uniting (combining) the main scanning direction Ds and the subsidiary scanning direction Df. The movement of the ink cartridge 18 in the Ds-Df united direction means that the ink cartridge 18 is actively moved in the Ds-Df united direction. The movement does not include, for example, such movement that the movement is accidentally caused slightly in the subsidiary scanning direction Df as well in the configuration in which the movement is performed in only the main scanning direction Ds. The following description will be made in the same manner as described above. Each of the moving force applying units 43 may be, for example, an urging member. Each of the moving force applying units 43 may be, for example, a plate spring. The two moving force applying units 43 are provided on a wall portion 41*b*1 which is included in the partition wall 41*b* and which is arranged at a position interposed by the respective ink cartridges 18. Each of the moving force applying units 43 is provided on the surface of the wall portion 41*b*1 opposed to each of the ink cartridges 18. In particular, one moving force applying unit 43 is provided on the front side of one surface of the wall portion 41*b*1, and the other moving force applying unit 43 is provided on the front side of the other surface of the wall portion 41*b*1. The two moving force applying units 43 have the back ends which are fixed to the wall portion 41*b*1. As shown in FIG. 5A, each of the moving force applying units 43 abuts against the side surface of each of the ink cartridges 18. Accordingly, each of the ink cartridges 18, which is disposed at the installation position P3, is urged in the Ds-Df united direction by the moving force applying unit 43 in a state in which the movement in the Ds-Df united direction (direction in which the front portions of the respective ink cartridges 18 are separated from each other in the main scanning direction Ds as compared with the back portions) is regulated by the regulating unit 42.

In the configuration as described above, as shown in FIG. 5B, the respective ink cartridges 18 are released from the regulation by removing the regulating unit 42 by a user. When the ink cartridges 18 are released from the regulation, the respective ink cartridges 18 are moved (rotated) to the removal positions P4 in the Ds-Df united direction from the installation positions P3 by the respective ends of the moving force applying units 43 while being supported by the respective rotation regulating units 44. Accordingly, the respective ink cartridges 18 are moved to the removal positions P4 as the positions at which the respective ink cartridges 18 are separated from each other in at least the main scanning direction Ds as compared with the installation positions P3.

As described above, according to the image recording apparatus 10 of this embodiment, when the ink cartridges 18 are released from the regulation having been exerted by the regulating unit 42, the ink cartridges 18, which are disposed at the installation positions P3, are moved by the moving force applying units 43 from the installation positions P3 toward the removal positions P4 separated at least in the main scanning direction Ds. Accordingly, the ink cartridges 18 are moved in at least the main scanning direction Ds. On this account, even when the respective ink cartridges 18 are arranged while being aligned in the main scanning direction Ds, the user easily takes out the ink cartridges 18 after the movement. Therefore, the exchange operation performance of the ink cartridge 18 is improved.

Third Embodiment

Figure 6A:
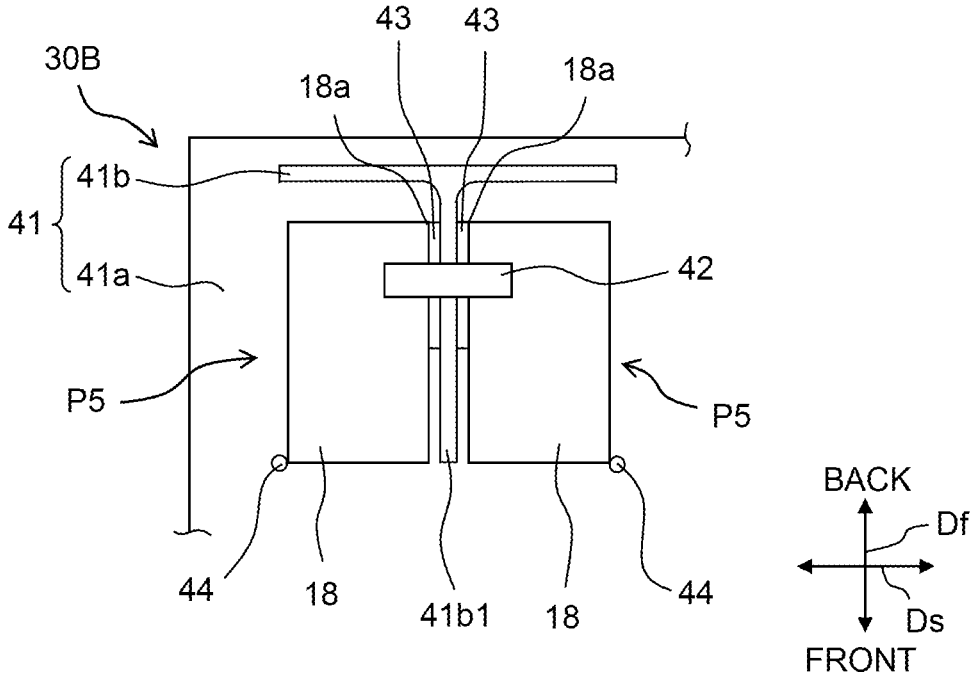
FIG. 6A shows a state provided before removing ink cartridges in a third embodiment.
Figure 6B:
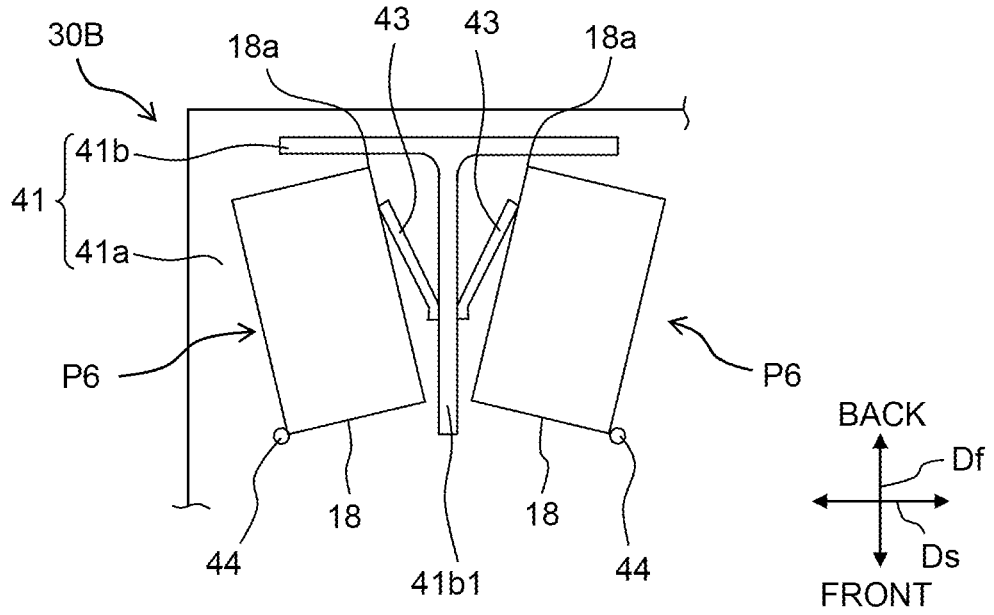
FIG. 6B shows a state provided when the ink cartridges are removed.

Next, an explanation will be made about the configuration and the method for taking out the ink cartridge 18 when the ink cartridge 18 is exchanged in a third embodiment. FIGS. 6A and 6B show situations as viewed from the upward. Note that in the third embodiment, the constitutive elements, which are the same as those of the second embodiment described above, are designated by the same reference numerals, any explanation of which will be omitted.

As shown in FIG. 6A, the respective ink cartridges 18 are provided and aligned in the main scanning direction Ds. A cartridge installing unit 30B of the third embodiment is provided with a main installing body unit 41, a regulating unit 42, and two moving force applying units 43, in the same manner as the cartridge installing unit 30A of the second embodiment.

With reference to FIG. 6A, the main installing body unit 41 has a base unit (base) 41*a* and a partition wall 41*b*. The position, at which the ink cartridge 18 is engaged with the regulating unit 42, is designated as "installation position P5". Further, the respective ink cartridges 18 are rotated when the respective ink cartridges 18 are released from the regulation having been exerted by the regulating unit 42 as described later on. Rotation regulating units (first shafts) 44, which are columnar, are provided respectively at the front, at front portions of the respective ink cartridges 18. The rotation regulating units 44 extend in the upward-downward direction. The rotation regulating unit 44 abuts against the surface disposed on the side opposite to the surface on which each of the ink cartridges 18 makes contact with the moving force applying unit 43.

The respective moving force applying units 43 apply the moving force to move the ink cartridges 18 in the directions each including the main scanning direction Ds component and the subsidiary scanning direction Df component with respect to each of the ink cartridges 18 when the ink cartridges 18 are released from the regulation having been exerted by the regulating unit 42 with respect to the ink cartridges 18 disposed at the installation positions P5. The two moving force applying units 43 are provided on a wall portion 41*b*1 which is included in the partition wall 41*b* and which is arranged at a position interposed by the respective ink cartridges 18. Each of the moving force applying units 43 is provided on the surface of the wall portion 41*b*1 opposed to each of the ink cartridges 18. In particular, one moving force applying unit 43 is provided on the back side of one surface of the wall portion 41*b*1, and the other moving force applying unit 43 is provided on the back side of the other surface of the wall portion 41*b*1. In this embodiment, the two moving force applying units 43 have front ends thereof which are fixed to the wall portion 41*b*1. As shown in FIG. 6A, each of the moving force applying units 43 abuts against the side surface of each of the ink cartridges 18. Accordingly, each of the ink cartridges 18, which is disposed at the installation position P5, is urged in the Ds-Df united direction by the moving force applying unit 43 in a state in which the movement in the Ds-Df united direction (direction in which the back portions of the respective ink cartridges 18 are separated from each other in the main scanning direction Ds as compared with the front portions) is regulated by the regulating unit 42.

In the configuration as described above, as shown in FIG. 6B, the respective ink cartridges 18 are released from the regulation having been exerted on the respective ink cartridges 18, by removing the regulating unit 42 by a user. When the ink cartridges 18 are released from the regulation, the respective ink cartridges 18 are moved (rotated) to the removal positions P6 in the Ds-Df united direction from the installation positions P5 by the respective ends of the moving force applying units 43 while being supported by the respective rotation regulating units 44. Accordingly, the respective ink cartridges 18 are moved to the removal positions P6 as the positions at which the respective ink cartridges 18 are separated from each other in at least the main scanning direction Ds as compared with the installation positions P5.

As described above, according to the image recording apparatus 10 of this embodiment, when the ink cartridges 18 are released from the regulation having been exerted by the regulating unit 42, the ink cartridges 18, which are disposed at the installation positions P5, are moved by the moving force applying units 43 from the installation positions P5 toward the removal positions P6 separated at least in the main scanning direction Ds. Accordingly, the ink cartridges 18 are moved in at least the main scanning direction Ds. On this account, even when the respective ink cartridges 18 are arranged while being aligned in the main scanning direction Ds, the user easily takes out the ink cartridges 18 after the movement. Therefore, the exchange operation performance of the ink cartridge 18 is improved.

In the second and third embodiments, in the cartridge installing unit 30A, 30B, the installation position P3, P5 is separated from the removal position P4, P6 in the movement direction including the component of the main scanning direction Ds. In the second and third embodiments, the movement direction is the Ds-Df united direction. That is, the movement direction includes the component of the main scanning direction Ds and the component of the subsidiary scanning direction Df, and the movement direction does not include the component of the upward-downward direction. In particular, in the second and third embodiments, the movement direction is the rotation direction (first rotation direction) in which the rotation regulating unit (the first shaft) 44 is the center of rotation. The moving force applying unit 43 rotates the ink cartridge 18 from the installation position P3, P5 to the removal position P4, P6 in the movement direction (first rotation direction). The moving force applying unit 43 rotates the ink cartridge 18 around the rotation regulating unit (the first shaft) 44. The ink cartridge 18 contacts with the rotation regulating unit (the first shaft) 44 in a case that the moving force applying unit 43 rotates the ink cartridge 18. The moving force applying unit 43 moves the ink cartridge 18 in the movement direction in the orientation to make separation from the wall portion 41*b*1. In the main scanning direction Ds, the maximum distance between the wall portion 41*b*1 and the ink cartridge 18 disposed at the removal position P4, P6 is larger than the maximum distance between the wall portion 41*b*1 and the ink cartridge 18 disposed at the installation position P3, P5. The moving force applying unit 43 moves the two ink cartridges 18 (first cartridge, second cartridge) disposed adjacently to one another in the main scanning direction Ds, in the orientation to make separation from each other in the main scanning direction Ds. In particular, the moving force applying unit 43 rotates the two ink cartridges 18 in the orientation in which the rotation ends 18*a* of the two ink cartridges 18 are separated from each other in the main scanning direction Ds. In the second and third embodiments, the cartridge installing unit 30A, 30B has the first moving force applying unit 43 for moving one (first ink cartridge) of the two ink cartridges 18 disposed adjacently to one another in the main scanning direction Ds and the second moving force applying unit 43 for moving the other (second ink cartridge).

Fourth Embodiment

Figure 7A:
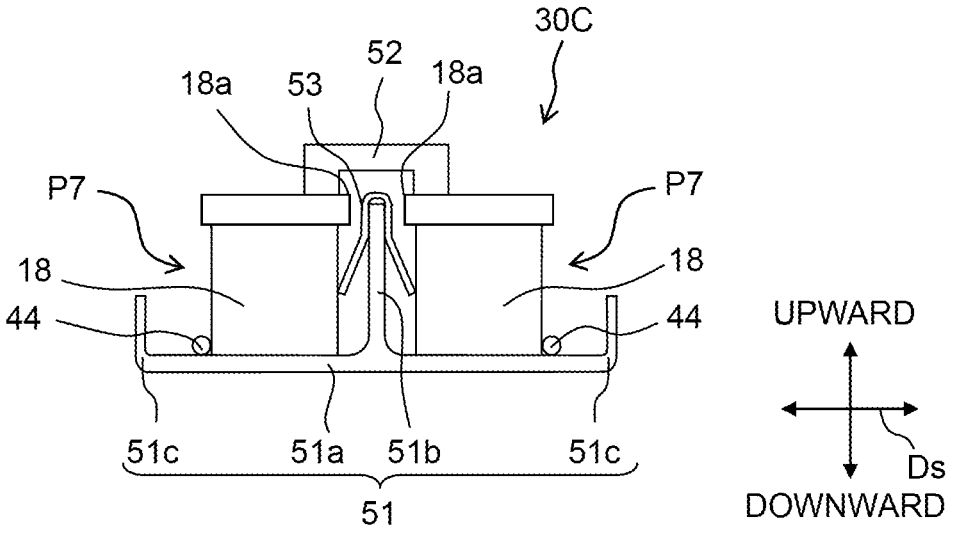
FIG. 7A shows a state provided before removing ink cartridges in a fourth embodiment.
Figure 7B:
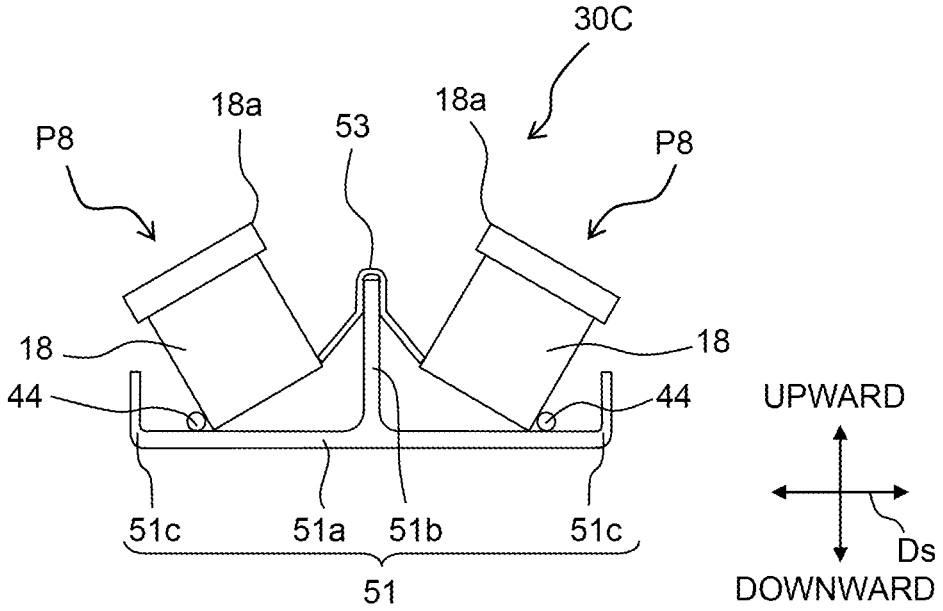
FIG. 7B shows a state provided when the ink cartridges are removed.

Next, an explanation will be made about the configuration and the method for taking out the ink cartridge 18 when the ink cartridge 18 is exchanged in a fourth embodiment. FIGS. 7A and 7B show a cartridge installing unit 30C as viewed from the front (from the downstream side in the conveying direction, i.e., in the subsidiary scanning direction (second direction) Df). Note that in the fourth embodiment, the constitutive elements, which are the same as those of the first embodiment described above, are designated by the same reference numerals, any explanation of which will be omitted.

As shown in FIG. 7A, the respective ink cartridges 18 are provided and aligned in the main scanning direction Ds. The respective ink cartridges 18 are held or retained by a cartridge installing unit 30C. The cartridge installing unit 30C of the fourth embodiment is provided with a main installing body unit 51, a regulating unit 52, and a moving force applying unit 53, in the same manner as the cartridge installing unit 30 of the first embodiment.

With reference to FIG. 7A, the main installing body unit 51 has a base unit (base) 51*a* having a placing surface on which the respective ink cartridges 18 are placed, and a partition wall 51*b* which is provided on the base unit 51*a* and which comparts the mutually adjoining ink cartridges 18. The partition wall 51*b* is provided between the two cartridges 18 disposed adjacently to one another in the main scanning direction Ds. Circumferential wall portions 51*c*, which extend upwardly, are provided at the respective end portions in the main scanning direction Ds of the base unit 51*a*. The base unit 51*a* extends in at least the main scanning direction Ds. Further, the partition wall 51*b* extends in the upward direction from the center in the main scanning direction Ds of the base unit 51*a*.

In this embodiment, the regulating unit 52 is configured to be engageable with the two mutually adjoining ink cartridges 18. The regulating unit 52 is formed to have, for example, a substantially C-shaped form. The type of engagement of the regulating unit 52 with respect to the respective ink cartridges 18 may be, for example, a fitting type or a magnet type. The respective ink cartridges 18 are engaged with the regulating unit 52 in a state in which the respective ink cartridges 18 are placed on the base unit 51*a*. The position, at which the ink cartridge 18 is engaged with the regulating unit 52, is designated as "installation position P7". Further, the respective ink cartridges 18 are rotated when the respective ink cartridges 18 are released from the regulation having been exerted by the regulating unit 52 as described later on. Columnar rotation regulating units (second shafts) 44 are provided on the both sides of the base unit 51*a* respectively. The rotation regulating units 44 extend in the subsidiary scanning direction Df. The rotation regulating units 44 abut against the surfaces disposed on the side opposite to the surfaces on which the respective ink cartridges 18 make contact with the moving force applying unit 53.

The moving force applying unit 53 applies the moving force to move the ink cartridges 18 in the direction (hereinafter referred to as "Ds-upward/downward united direction") including the main scanning direction Ds component and the upward-downward direction component with respect to the ink cartridges 18 when the respective ink cartridges 18 disposed at the installation positions P7 are released from the regulation having been exerted by the regulating unit 52. The moving force applying unit 53 may be, for example, an urging member. The moving force applying unit 53 may be, for example, a plate spring. As shown in FIG. 7A, the moving force applying unit 53 as the plate spring has the both end portions which are folded downwardly in the directions to make separation from each other while allowing the central portion thereof to be supported by the uppermost portion of the partition wall 51*b*. The both ends of the moving force applying unit 53 abut against the side surfaces of the ink cartridges 18. Accordingly, the respective ink cartridges 18, which are disposed at the installation positions P7, are urged in the Ds-upward/downward united direction by the respective ends of the moving force applying unit 33 in a state in which the movement in the Ds-upward/downward united direction is regulated by the regulating unit 52.

In the configuration as described above, as shown in FIG. 7B, the respective ink cartridges 18 are released from the regulation by removing the regulating unit 52 by a user. When the ink cartridges are released from the regulation, the respective ink cartridges 18 are moved (rotated) to the removal positions P8 in the Ds-upward/downward united direction from the installation positions P7 by the respective ends of the moving force applying unit 53 while being supported by the respective rotation regulating units 44. Accordingly, the respective ink cartridges 18 are moved to the removal positions P8 as the positions at which the respective ink cartridges 18 are separated from each other in the main scanning direction Ds as compared with when the respective ink cartridges 18 are disposed at the installation positions P7.

As described above, according to the image recording apparatus 10 of this embodiment, when the ink cartridges 18 are released from the regulation having been exerted by the regulating unit 52, the ink cartridges 18, which are disposed at the installation positions P7, are moved toward the removal positions P8 which are separated in at least the main scanning direction Ds from the installation positions P7 by the moving force applying unit 53. Accordingly, the ink cartridges 18 are moved in at least the main scanning direction Ds. On this account, even when the respective ink cartridges 18 are arranged while being aligned in the main scanning direction Ds, the user easily takes out the ink cartridge 18 after the movement. Therefore, the exchange operation performance of the ink cartridge 18 is improved.

In the fourth embodiment, in the cartridge installing unit 30C, the installation position P7 is separated from the removal position P8 in the movement direction including the component of the main scanning direction Ds. In the fourth embodiment, the movement direction is the Ds-upward/downward united direction. That is, the movement direction includes the component of the main scanning direction Ds and the component of the upward-downward direction, and the movement direction does not include the component of the subsidiary scanning direction Df. In particular, in the fourth embodiment, the movement direction is the rotation direction (second rotation direction) in which the regulating unit (the second shaft) 44 is the center of rotation. The moving force applying unit 53 rotates the ink cartridge 18 from the installation position P7 to the removal position P8 in the movement direction (second rotation direction). The moving force applying unit 53 rotates the ink cartridge 18 around the regulating unit (the second shaft) 44. The ink cartridge 18 contacts with the regulating unit (the second shaft) 44 in a case that the moving force applying unit 53 rotates the ink cartridge 18. The moving force applying unit 53 moves the ink cartridge 18 in the movement direction in the orientation to make separation from the partition wall 51*b*. In the main scanning direction Ds, the maximum distance between the partition wall 51*b* and the ink cartridge 18 disposed at the removal position P8 is larger than the maximum distance between the partition wall 51*b* and the ink cartridge 18 disposed at the installation position P7. The moving force applying unit 53 moves the two ink cartridges 18 (first cartridge, second cartridge) disposed adjacently to one another in the main scanning direction Ds so that the two ink cartridges 18 are separated from each other in the main scanning direction Ds. In particular, the moving force applying unit 53 rotates the two ink cartridges 18 in the orientation in which the rotation ends 18*a* of the two ink cartridges 18 are separated from each other in the main scanning direction Ds.

Modified Embodiments

The present invention is not limited to the embodiments described above, which can be variously modified or deformed within a range without deviating from the gist or essential characteristics of the present invention. The modification can be made, for example, as follows.

In the embodiments described above, the regulating units 32, 42, 52, each of which is in such a mode that the ink cartridges 18 are directly engaged therewith, are adopted. However, there is no limitation thereto. For example, it is also possible to adopt the following mode. That is, a main installing body unit for supporting the ink cartridges 18 is configured to be movable, and the ink cartridges 18 are engaged with the main installing body unit.

Further, in the embodiments described above, the plate springs are adopted as the moving force applying units 33, 43, 53. However, there is no limitation thereto. For example, it is also allowable to adopt any other moving force applying unit including, for example, a coil spring (urging member).

Further, in the embodiments described above, the removal positions P2, P4, P6, P8 are the positions at which the separation is effected in the direction including only the main scanning direction component (first embodiment), or in the united direction of the main scanning direction component and any other one direction component (second to fourth embodiments), on the basis of the installation positions P1, P3, P5, P7. However, there is no limitation thereto. The united direction may be a direction obtained by uniting or combining three direction components. That is, the united direction can be a direction obtained by uniting or combining the main scanning direction component, the subsidiary scanning direction component, and the upward-downward direction component.

Further, in the embodiments described above, the ink cartridges 18 are moved from the installation positions P1, P3, P5, P7 to the removal positions P2, P4, P6, P8 separated in the direction including at least the main scanning direction component. However, there is no limitation thereto. The following configuration is also available. That is, one ink cartridge 18, which is included in the two ink cartridges 18 adjacent to one another in the main scanning direction Ds, is moved upwardly by a predetermined amount. Further, the other ink cartridge 18 is moved upwardly by an amount larger than the predetermined amount. Also in this case, even when the respective ink cartridges 18 are arranged while being aligned in the main scanning direction Ds, a user easily takes out the ink cartridge 18 after the movement. Therefore, the exchange operation performance of the ink cartridge 18 is improved.

In the embodiments described above, both of the two ink cartridges 18 disposed adjacently to one another in the main scanning direction Ds are configured to be movable in the direction including the main scanning direction component respectively. However, there is no limitation thereto. Only one of the two ink cartridges 18 disposed adjacently to one another in the main scanning direction Ds may be configured to be movable in the direction including the main scanning direction component. In this case, the other cartridge may be configured to be unmovable (immovable), or the other cartridge may be configured to be movable upwardly or frontwardly.

Further, in the embodiment described above, the following configuration is adopted. That is, the protrusion 18*a* is provided at the upper portion of the ink cartridge 18, and the hole 32*b* is provided for the regulating unit 32. The protrusion 18*a* is fitted to the hole 32*b* in the state in which the ink cartridge 18 is engaged with the engaging portion 32*a* of the regulating unit 32. However, there is no limitation thereto. The foregoing configuration of the fitting is not essential provided that the engagement of the regulating unit 32 with respect to the ink cartridge 18 is reliable.

Further, both of the two ink cartridges 18 disposed adjacently to one another in the main scanning direction Ds may be configured to be simultaneously movable. For example, the two ink cartridges 18 disposed adjacently to one another may be configured so that the two ink cartridges can be simultaneously released from the regulation having been exerted by the regulating unit. When the two ink cartridges 18 are simultaneously released from the regulation, it is thereby possible to simultaneously move the two ink cartridges 18. On the contrary, the two ink cartridges 18 disposed adjacently to one another in the main scanning direction Ds may be configured to be distinctly movable. For example, the following configuration is also available. That is, even when one cartridge of the two ink cartridges 18 disposed adjacently to one another is released from the regulation, the regulation is retained for the other cartridge.

Note that all of the embodiments and the modified embodiments described above may be combined with each other provided that no mutual exclusion occurs with respect to one another.

What is claimed is:

1. An image recording apparatus comprising:

a carriage which holds a head configured to discharge an ink, and which is configured to move in a main scanning direction, and a cartridge installing unit in which an ink cartridge is to be detachably installed, wherein the cartridge installing unit includes:

a base having a placing surface and configured to hold the ink cartridge on the placing surface;

a force applying unit configured to move the ink cartridge from an installation position to a removal position separated from the installation position in a movement direction including a component of the main scanning direction; and a regulating unit configured to regulate a movement of the ink cartridge from the installation position to the removal position, and the force applying unit is configured to move the ink cartridge from the installation position to the removal position in a case that the ink cartridge is released from a regulation by the regulating unit.

2. The image recording apparatus according to claim 1, wherein the regulating unit is configured to engage with the ink cartridge at the installation position.

3. The image recording apparatus according to claim 1, wherein the force applying unit is a plate spring configured to apply a moving force in the movement direction to the ink cartridge in the case that the ink cartridge is released from the regulation by the regulating unit.

4. The image recording apparatus according to claim 3, wherein the plate spring is configured to abut against the ink cartridge at the installation position so as to urge the ink cartridge in the movement direction.

5. The image recording apparatus according to claim 1, wherein the movement direction is the main scanning direction.

6. The image recording apparatus according to claim 1, wherein the movement direction includes the component of the main scanning direction and a component of a subsidiary scanning direction which is orthogonal to the main scanning direction and which is parallel to the placing surface.

7. The image recording apparatus according to claim 6, wherein:

the cartridge installing unit further includes a first shaft extending in an orthogonal direction which is orthogonal to the main scanning direction and the subsidiary scanning direction; and the force applying unit is configured to rotate the ink cartridge around the first shaft from the installation position to the removal position.

8. The image recording apparatus according to claim 7, wherein:

the ink cartridge contacts with the first shaft in a case that the force applying unit rotates the ink cartridge.

9. The image recording apparatus according to claim 1, wherein the movement direction includes the component of the main scanning direction and a component of an orthogonal direction which is orthogonal to the placing surface.

10. The image recording apparatus according to claim 9, wherein:

the cartridge installing unit further includes a second shaft extending in a subsidiary scanning direction which is orthogonal to the main scanning direction and the orthogonal direction; and the force applying unit is configured to rotate the ink cartridge around the second shaft from the installation position to the removal position.

11. The image recording apparatus according to claim 10, wherein:

the ink cartridge contacts with the second shaft in a case that the force applying unit rotates the ink cartridge.

12. The image recording apparatus according to claim 10, wherein the second shaft is provided on the placing surface.

13. The image recording apparatus according to claim 1, wherein the image recording apparatus is configured to discharge the ink in a state that the ink cartridge is positioned at the installation position.

14. The image recording apparatus according to claim 1, wherein:

the cartridge installing unit further includes a partition wall which is provided between the ink cartridge and another ink cartridge aligned adjacently to the ink cartridge in the main scanning direction; and the force applying unit is configured to move the ink cartridge to be separated farther from the partition wall in the movement direction.

15. The image recording apparatus according to claim 14, wherein a maximum distance in the main scanning direction between the partition wall and the ink cartridge at the removal position is larger than a maximum distance in the main scanning direction between the partition wall and the ink cartridge at the installation position.

16. The image recording apparatus according to claim 1, wherein:

the cartridge includes a first ink cartridge and a second ink cartridge which are aligned adjacently to one another in the main scanning direction; and the force applying unit is configured to move the first ink cartridge and the second ink cartridge respectively so that the first ink cartridge and the second ink cartridge are separated from each other in the main scanning direction.

17. The image recording apparatus according to claim 16, wherein:

the force applying unit is configured to rotate the first ink cartridge and the second ink cartridge respectively so that a rotation end of the first ink cartridge and a rotation end of the second ink cartridge are separated from each other in the main scanning direction.

18. The image recording apparatus according to claim 16, wherein the force applying unit includes:

a first force applying unit configured to move the first ink cartridge; and a second force applying unit configured to move the second ink cartridge.

19. The image recording apparatus according to claim 1, wherein the cartridge installing unit is provided on the carriage.

* * * * *